US005701818A

United States Patent [19]

Mohrmann

[11] Patent Number: 5,701,818

[45] Date of Patent: Dec. 30, 1997

[54] PRINTING PRESS CYLINDER COUPLING METHOD AND APPARATUS

[75] Inventor: Hans Dierk Mohrmann, Höchberg, Germany

[73] Assignee: Koenig & Bauer-Albert Aktiengesellschaft, Wurzburg, Germany

[21] Appl. No.: 726,684

[22] Filed: Oct. 7, 1996

[30] Foreign Application Priority Data

Oct. 7, 1995 [DE] Germany ..... 195 37 421.5

[51] Int. Cl.[6] ..... B41F 13/10

[52] U.S. Cl. ..... 101/375; 192/69.8; 192/85 A

[58] Field of Search ..... 101/375, 212; 192/69, 69.8, 85 R, 85 A

[56] References Cited

U.S. PATENT DOCUMENTS

| | | | |
|---|---|---|---|
| 3,785,157 | 1/1974 | Kittle et al. | 92/172 |
| 4,438,695 | 3/1984 | Maier et al. | 101/153 |
| 4,566,566 | 1/1986 | Vuillet | 192/24 |
| 4,581,979 | 4/1986 | Compton et al. | 92/23 |
| 5,060,776 | 10/1991 | Skog et al. | 192/85 R |
| 5,105,922 | 4/1992 | Yant | 192/3.58 |
| 5,161,464 | 11/1992 | Albrecht | 101/375 |
| 5,170,708 | 12/1992 | Dilalla | 101/248 |

FOREIGN PATENT DOCUMENTS

| | | |
|---|---|---|
| 396871 | 6/1924 | Germany . |
| 1 858 031 | 6/1992 | Germany . |
| 42 14 228 | 2/1994 | Germany . |

*Primary Examiner*—Edgar S. Burr
*Assistant Examiner*—Dave A. Ghatt
*Attorney, Agent, or Firm*—Jones, Tullar & Cooper, P.C.

[57] ABSTRACT

A cylinder in a rotary printing press is coupled to a driving wheel or gear by the engagement of two coupling disks. One of the disks is shiftable into coupling engagement with the other disk by application of a pressure medium to a work cylinder. A control valve is carried by the shiftable disk and limits the force of the pressure medium by use of a bleed passage that is closed only when coupling has been accomplished. The force of the pressure medium is at a higher level when coupling has been fully completed.

12 Claims, 2 Drawing Sheets

PRINTING PRESS CYLINDER COUPLING METHOD AND APPARATUS

FIELD OF THE INVENTION

The present invention is directed generally to a printing press cylinder coupling method and apparatus. More particularly, the present invention is directed to a method and apparatus for coupling a cylinder of a rotary printing press to a toothed driving wheel. Most specifically, the present invention is directed to a printing press cylinder coupling method and apparatus which uses a switchable coupling including a cylinder coupling disk and a driving wheel coupling disk. The coupling disks are engageable with each other to put the cylinder in connection with the toothed driving wheel in a positive, torsion-proof connection. One of the coupling disks is movable axially toward and away from the other to accomplish this positive coupling. A pressurized medium is utilized to accomplish the axial shifting of one of the disks with respect to the other. A rise in pressure in the pressurized medium in a work cylinder is used to indicate the completion of the coupling of the cylinder to the toothed driving wheel.

DESCRIPTION OF THE PRIOR ART

In the field of rotary printing, it is frequently desirable to be able to effect the coupling and the uncoupling of a cylinder to a drive assembly, such as a toothed driving wheel or gear. Such a coupling must be a positive one to insure that there will be no slippage or relative movement, but should also be one that is quickly and easily uncoupled.

In the German Utility Model DE Gbm 1 858 031 there is disclosed a device that is usable to accomplish the coupling of a cylinder of a rotary printing press to a toothed driving wheel. In this prior art device, the cylinder crown or barrel is provided with a first coupling disk that is pressed against a second, axially adjustable coupling disk. A work cylinder is used to accomplish the axial shifting of the axially adjustable coupling disk. This axially adjustable coupling disk is rigidly or securely connected with the toothed driving wheel.

A limitation of this prior art device is that it is not easy to accomplish the uncoupling of the cylinder crown or barrel from the toothed driving wheel. The cylinder crown must be disassembled in order to effect this disconnection. Such a coupling device will not satisfy the need for a coupling that is operable in a rapid manner.

It is clear that a need exists for a printing press cylinder coupling device that overcomes the limitations of the prior art. The device for coupling a cylinder in accordance with the present invention provides such a device and is a significant advance over the prior art.

SUMMARY OF THE INVENTION

It is an object of the present invention to provide a printing press cylinder coupling method and device.

Another object of the present invention is to provide a method and a device for coupling a cylinder of a rotary printing press to a toothed driving wheel.

A further object of the present invention is to provide a printing press cylinder coupling that uses a switchable coupling.

Still another object of the present invention is to provide a device for coupling a cylinder of a rotary printing press which is not subject to substantial wear.

Yet a further object of the present invention is to provide a printing press cylinder coupling that uses a cylinder coupling disk and a driving wheel coupling disk.

Even still another object of the present invention is to provide a coupling device in which a pressure medium is used to effect the coupling.

As will be set forth in detail in the description of the preferred embodiment which is presented subsequently, the printing press cylinder coupling method and device in accordance with the present invention utilizes a cylinder coupling disk and a driving wheel coupling disk. The two disks have cooperable spur teeth on their adjacent side faces. These spur teeth are engageable with each other in only one position and effect a secure coupling of the cylinder to the driving gear wheel when the disks are brought into contact. One of the two coupling disks is axially shiftable toward and away from the other disk by application of a pressure medium to a work cylinder. A control valve is carried by the axially slidable disk and provides a bleed passage for the pressure medium. This bleed passage stays open until the two disks are securely coupled. Once the two disks have been brought into their securely coupled position, the bleed passage is closed. This creates an increase in pressure in the work cylinder with the increase in pressure being usable as an indication that a secure coupling has been effected. The two pressures in the cylinder are measured by a manometric switch that is placed in the pressure medium supply line.

The cylinder coupling method and device of the present invention provides for the accomplishment of a gentle, low wear coupling between the two coupling disks. The axially shiftable disk is moved into secure coupling contact with the fixed position disk by the application of the pressure medium at a relatively reduced pressure because of the provision of the bleed passage in the control valve. Once the secure coupling of the two disks has been accomplished, the bleed passage will close. This will then allow the full force of the pressure medium to be applied against the axially shiftable coupling disk by the working chamber. At this point, there is no axial movement between the two coupling disks so that the full pressure medium force is used only to hold the two coupling disks in place in their coupled position.

A pressure gauge, such as a manometer that is provided with a switch, is placed in the pressure medium supply line. The pressure sensed in the work cylinder by the manometer will increase once the secure coupling has been fully accomplished. As this increased pressure is sensed, the manometric switch can issue an electrical control signal that can be used to initiate other pressure operations. The use of the manometer and its associated switch eliminates problems caused by oil mist or the transmission of data from a rotating or axially displaceable element.

The control valve which is carried by the axially shiftable coupling disk, and which provides the bleed passage for the pressure medium until a complete coupling has been accomplished, is a small, uncomplicated structure. It is actuated directly by contact between the two coupling disks. The bleed passage is formed as an annular space between a slidable control piston and a slidable pressure sleeve. The size of this annular gap is easily set during manufacture of the control valve. The pressure sleeve that forms the bleed passage, also serves as a guide for the sliding movement of the control piston. As the two disks are brought into their fully coupled positions by axial movement of one disk with respect to the other, the pressure sleeve is caused to slide in the housing of the control valve and causes the control piston to move against the force of the pressure medium and to thereby close the bleed passage. This closure of the bleed passage gives rise to the increase in pressure in the cylinder chamber of the work cylinder and thus provides a signal that the coupling has been accomplished.

The printing press cylinder coupling assembly in accordance with the present invention overcomes the limitations of the prior art devices. It is a substantial advance in the art.

BRIEF DESCRIPTION OF THE DRAWINGS

While the novel features of the printing press cylinder coupling in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
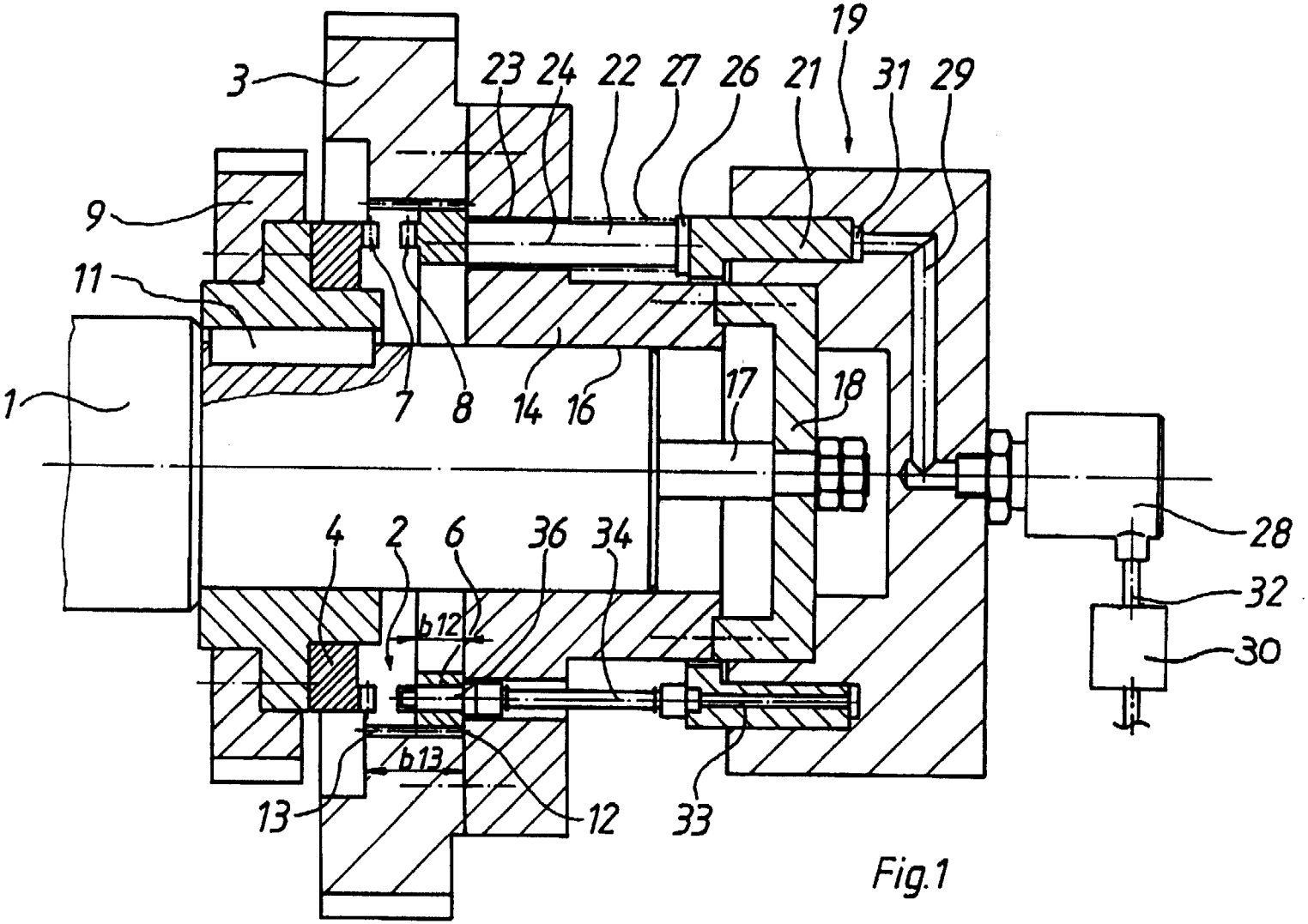
FIG. 1 is a schematic cross-sectional view of a preferred embodiment of the printing press cylinder coupling in accordance with the present invention and showing the device in its uncoupled position.

Referring initially to FIG. 1, there may be seen a cylinder trunnion or journal 1 that is typically positioned at the end of a cylinder which is used in a rotary printing press. Only the cylinder journal or pin 1 is depicted in FIG. 1 of the drawings. It will be understood that the cylinder, of which cylinder journal or pin 1 is a part, is not depicted in the drawings, since it is generally conventional and forms no part of the present invention. Similarly, the rotary printing press, in which the cylinder that includes cylinder journal 1, operates, is not shown in the drawings since it is of generally well known construction.

As may be seen in FIG. 1, the cylinder journal 1 can be connected with a toothed driving wheel, generally at 3, by means of a switchable coupling, generally at 2. This switchable coupling utilizes a cylinder coupling disk 4 and a driving wheel coupling disk 6. Both of these coupling disks 4 and 6 are generally similar in overall shape and have spur teeth 7 and 8, respectively on their, generally planar, facing side surfaces, as seen in FIG. 1. These spur teeth 7 and 8 are matched to each other and have a cooperating pattern which will allow them to matingly engage only when the coupling disks 4 and 6 are in one defined rotational position with respect to each other. This means that the coupling 2 is structured as a so-called one value or single position coupling. In one possible configuration, the coupling disk 4 could be provided with one or two spur teeth 7 that are of different shapes or widths than the other ones of the spur teeth 7. For example, one or more of these spur teeth could be broader than the others. A corresponding one or ones of the spur teeth 8 on the driving wheel disk 6 could be provided with gaps or spacings between themselves that correspond to these broader teeth. This will insure that the spur teeth 7 and 8 are engageable only when the two coupling disks 4 and 6 are in their desired rotational positions.

In the preferred embodiment of the printing press cylinder coupling device of the present invention, the coupling disk 4 is rigidly connected with the cylinder journal 1. This cylinder coupling disk 4 is located generally adjacent the cylinder crown or barrel and is also positioned generally adjacent a toothed gear wheel 9 that would be used to drive other cylinders, not shown, or to drive an inking unit or a similar piece of equipment. The cylinder coupling disk 4 and the toothed gear wheel 9 are secured to the cylinder journal 1 by the provision of a suitable key 11. The cylinder, together with the cylinder coupling disk 4 and the toothed gear wheel 9 are shiftable in the axial direction in a generally conventional manner. Such limited axial shifting of the cylinder may be necessary to properly set the side register.

The driving wheel coupling disk 6 is connected in a torsion-proof but axially shiftable manner to the toothed driving wheel 3. For this purpose, the driving wheel coupling disk 6 has outer teeth 12 of a width b12, for example b12=18 mm, on its circumference. These teeth 12 engage inner teeth 13 of a width b13, for example b13=40 mm, cut into the toothed driving wheel 3. The toothed driving wheel 3 is securely fastened on a hub 14. This hub 14 has a central bore 16 matched in size to the cylinder journal 1, so that the hub 14, together with the toothed driving wheel 3 which is carried by the hub 14, is seated rotatably and axially displaceable on the cylinder journal 1.

The axial displacement of the cylinder journal 1 and hence of the cylinder, which is used for setting the side register of the cylinder, is performed by means of an axially displaceable spindle 17, which is seated in the cylinder journal 1. This spindle 17 is connected with a register setting device, not shown, and is rigidly connected with the toothed driving wheel 3 by a disk 18, all as may be seen in FIG. 1. The cylinder journal 1 is thus axially shiftable with respect to the hub 14 to the extent necessary to effect proper side register of the cylinder.

A work cylinder 19 is flanged to the hub 14 which carries the toothed driving wheel 3. The work cylinder 19 has a ring-shaped or annular, axially displaceable piston 21, which acts on a generally cylinder-shaped array of pressure elements 22. A plurality, for example eight, of these pressure elements 22 are seated evenly in the circumferential direction, in bores 23 formed in the hub 14. These pressure elements 22 are connected with the driving wheel coupling disk 6 by means of screws 24. On their ends cooperating with the annular, displaceable piston 21, the pressure elements 22 are provided with collars 26. Pressure springs depicted schematically at 27 and acting on the pressure elements 22 are arranged between these collars 26 and a planar side face of the hub 14 opposite to the toothed driving wheel 3.

A rotary inlet 28 is connected with the work cylinder 19 and supplies a cylinder chamber 31 in the work cylinder 19 with a suitable pressure medium through a bore 29. A, for example electrical-pneumatic manometric switch, generally at 30, is provided in a feed line 32 for the rotary inlet 28, and whose switch point is set to 5 bar, for example. Via a bore 33 cut into the piston 21, the cylinder chamber 31 is connected with a line 34 which, in turn, is connected with a control valve 36. The control valve 36, which is shown in detail in FIG. 2, is fixedly installed in the axially shiftable, driving wheel coupling disk 6 and intermittently cooperates with the fixed, cylinder coupling disk 4 in a manner which will now be discussed in greater detail.

Figure 2:
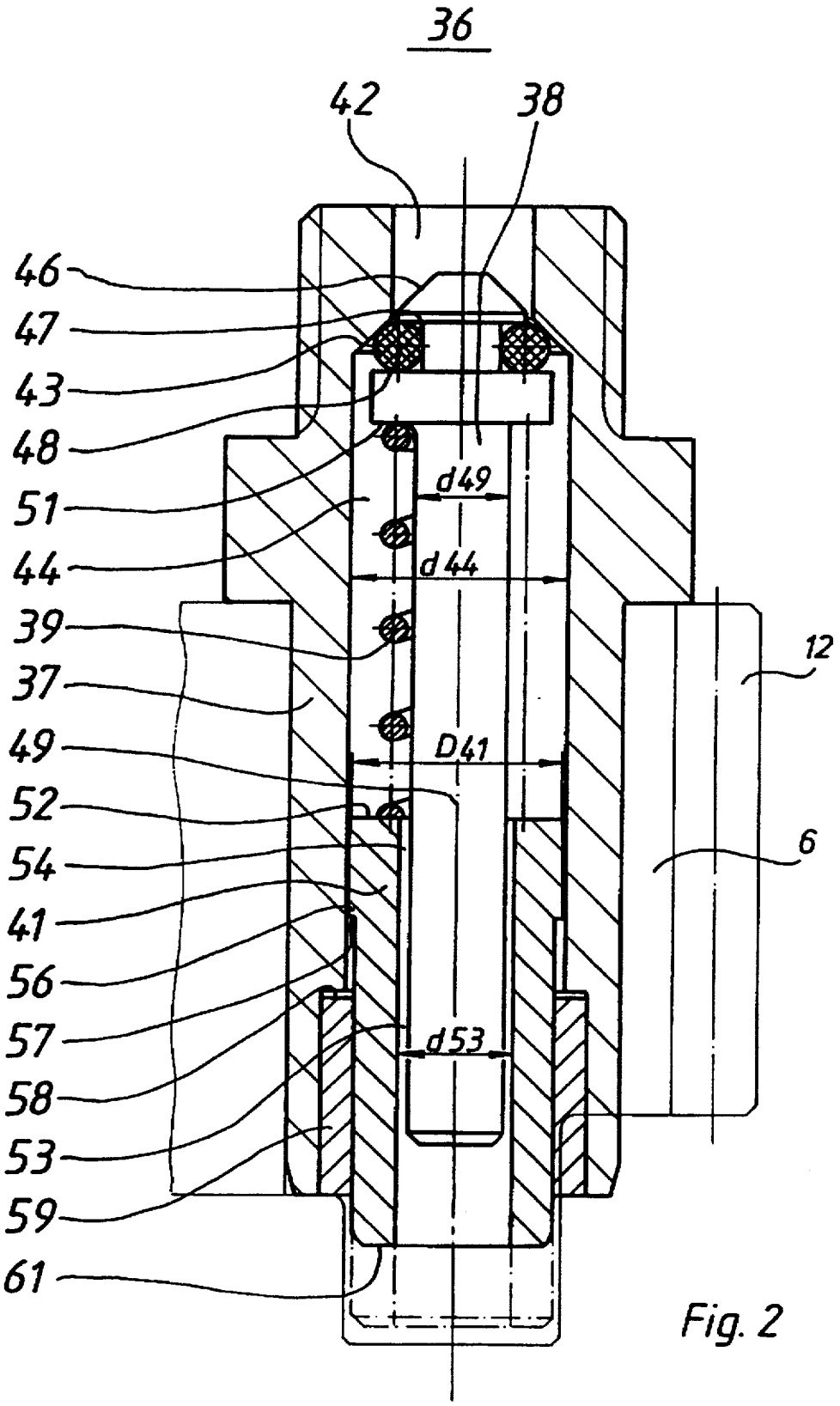
FIG. 2 is a schematic cross-sectional view of the control valve portion of the present invention.

Referring now primarily to FIG. 2, it will be seen that control valve 36 essentially consists of a housing 37, a control piston 38, a pressure spring 39 and a pressure sleeve 41. The housing 37 is provided on its inlet end with an inlet or first bore 42, a first end of which receives the pressure medium line 34 from the piston bore 33, and whose second end has a cone-shaped flair or depression 43. A second, continuous bore 44 of an interior diameter d44, for example d44=6.5 mm, is connected in the longitudinal direction with this inlet bore 42. The control piston 38 is disposed in this continuous bore 44 and is movable in the longitudinal direction in bore 44. This control piston 38 has a cone-shaped sealing head 46 on its first end. This cone-shaped sealing head 46 is provided with an annularly extending groove 47 for receiving a seal ring 48 such as, for example, an O-ring. A control piston shaft 49 of a diameter d49, for example d49=3 mm, extends from this cone-shaped sealing head 46 and is sized and utilized to receive the pressure spring 39. This pressure spring 39 presses with its first end against an underside 51 of the sealing head 46, and with its second end against an upper or interior front face 52 of the pressure sleeve 41. The pressure sleeve 41 has a bore 53 of a diameter d53, for example d53=3.5 mm, which extends in the longitudinal direction. The bore 53 of the pressure sleeve 41 and the shaft 49 of the control piston 38 form an annular gap or bleed passage 54. An outer diameter D41, for example D41=6.4 mm, of the pressure sleeve 41 is adapted, in the area of a pressurized sleeve shoulder 56, to the interior diameter d44 of the continuous bore 44 in the housing 37 in such a way that the pressure sleeve 41 is seated so that it can be displaced in the longitudinal direction. A front interior face 58 of a detent sleeve 59, which is fastened in the continuous bore 44 of the housing 37 for limiting the travel of the pressure sleeve 41, intermittently cooperates with a lower front face 57 of the shoulder 56. A lower exterior face 61 of the pressure sleeve 41 projects out of the housing 37. The pressure sleeve 41 can thus slide in the continuous bore 44 of the housing 37 between a fully extended position in which the lower front face 57 of the pressure sleeve shoulder 56 abuts the interior face 58 of the detent sleeve 59, and a fully retracted position in which the lower exterior face 61 of the pressure sleeve 41 is flush with the end of the housing 37. The pressure sleeve 41 is urged towards its extended position by the action of the control piston pressure spring 39.

In the preferred embodiment of the printing press cylinder coupling depicted in FIG. 1, the control valve 36 is positioned in the axially shiftable coupling disk 6 that is associated with the toothed driving wheel 3. When the two coupling disks 4 and 6 are in engagement with each other to effect a coupling of the cylinder to the driving wheel 3, the lower exterior face 61 of the pressure sleeve 41 is in contact with the fixed coupling disk 4 intermediate cooperating spur teeth 7 and 8.

The operation of the printing press cylinder coupling assembly in accordance with the present invention will now be discussed in detail. In a disengaged position of the coupling 2, as is depicted in FIG. 1, the cylinder chamber 31 of the work cylinder 19 is not charged with a pressure medium. Therefore, the pressure springs 27 push the annular piston 21 toward the right through the pressure elements 22 and at the same time pull the axially shiftable driving wheel coupling disk 6 along the inner teeth 13 of the driving wheel 3, to move the spur teeth 8 out of engagement with the spur teeth 7 of the fixed, cylinder coupling disk 4 until both coupling disks, 4 and 6, are out of engagement. In the process, the exterior face 61 of the pressure sleeve 41 of the control valve 36 loses contact with the fixed coupling disk 4, so that the pressure sleeve 41 is pressed against the detent sleeve 59 by the pressure spring 39 until it is in its fully extended position, at which time the pressure spring 39 is relaxed. To accomplish the coupling of the cylinder with the driving wheel 3, a suitable pressure medium is supplied to the work cylinder 19 through the rotary inlet 28 from the feed line 32 and the manometric switch 30. This pressure medium also flows to the control valve 36 through the line 34 and by means of the increasing pressure, pushes the cone-shaped sealing head 46 of the control piston 38 away from the cone-shaped flair or depression 43, so that pressure medium flows through a resulting angular gap. This pressure medium escapes to the outside through the annular gap or bleed passage 54 formed by the control piston 38 and the pressure sleeve 41. This annular gap or bleed passage 54 and the amount of pressure medium supplied to the work cylinder 19 are matched to each other in such a way that a first, coupling shifting, pressure p1 is created in the work cylinder 19, and the two coupling disks 4 and 6 are pressed into engagement with each other by the pressure elements 22. With the control valve 36 opened during the engagement process, a value of the first, coupling shifting pressure p1, for example p1=3.5 bar, is less than a final, engaged pressure p2, for example p2=6 bar, with the control valve 36 closed, when the disks 4 and 6 are in the engaged state. The value of the pressure p1 preferably is ⅓ to ⅔ of the final pressure p2. The supplied amount of pressure medium is metered for this, for example by means of a throttle, not shown.

With the control valve 36 still opened, the cylinder is rotated by an auxiliary driving device, not shown, so that the two coupling disks 4 and 6, which are pressed against each other, turn with respect to each other. During this process, the pressure sleeve 41 of the control valve 36 does not contact the axially fixed coupling disk 4, and the control valve 36 remains open. Once the two coupling disks 4 and 6 reach their defined engagement position, the two sets of spur teeth 7 and 8 are engaged with each other. Now the axially fixed coupling disk 4 presses against the exterior face 61 of the pressure sleeve 41 of the control valve 36 and slides sleeve 41 into the housing 37. This, in turn, puts the pressure spring 39, which cooperates with pressure sleeve 41, under tension. This pressure spring 39 which is now under tension, and whose pressure force is greater than a force acting on the control piston 38 by means of the pressure medium, pushes the control piston 38 against the flair or depression 43 in the housing 37, and the annular gap between the sealing head 46 and the depression 43 is thereby closed. The control valve 36 is thus closed, so that pressure medium cannot escape through the bleed passage 54 anymore, because of which the final pressure p2 is set in the work cylinder 19. The manometric switch 30 in the feed line 32 to the rotary inlet 28 is switched because of the pressure increase and issues an electrical signal which is used for further control of the press.

Instead of the directly mechanically actuated control valve 36, it would be possible to utilize an electromagnetic valve, for example. Such an electromagnetic valve 36 could be controlled by a sensor which would sense the position of the axially shiftable coupling disk 6 and could close the control valve 36 when the axially shiftable disk 6 was in an engaged position.

While a preferred embodiment of a printing press cylinder coupling device in accordance with the present invention has been set forth fully and completely hereinabove, it will be apparent to one of skill in the art that a number of changes in, for example, the overall size of the cylinder journal, the source of the pressure medium, the type of printing press in which the coupling is used, and the like could be made without departing from the true spirit and scope of the present invention which is accordingly to be limited only by the following claims.

What is claimed is:

1. A method for coupling a cylinder of a rotary printing press to a toothed driving wheel including:

providing a cylinder coupling disk secured to a journal of the cylinder;

providing a driving wheel coupling disk secured to the driving wheel;

utilizing a work cylinder that is chargeable with a pressure medium and shifting one of said disks toward the other of said disks by applying the pressure medium to said work cylinder to effect said coupling;

charging said work cylinder with the pressure medium at a first pressure during said shifting, and at a second pressure when said coupling is fully engaged; and adjusting the pressure of said pressure medium to render said first pressure less than said second pressure.

2. The method of claim 1 further including shifting said disks axially with respect to an axis of rotation of the cylinder with respect to each other by applying the pressure medium to said work cylinder.

3. The method of claim 1 further including bleeding a portion of the pressure medium from said work cylinder during said coupling engagement to provide the pressure medium at said first pressure.

4. A printing press cylinder coupling device for coupling a cylinder to a toothed driving wheel comprising:

a toothed drive wheel;

a cylinder journal extending from the cylinder;

a cylinder coupling disk attached to said cylinder journal;

a driving wheel coupling disk attached to the toothed driving wheel;

means for shifting one of said coupling disks toward and away from the other of said coupling disks;

a work cylinder chargeable by a pressure medium and operable to shift said one coupling disk toward said other coupling disk;

a control valve carried by said one of said coupling disks, said control valve receiving the pressure medium from said work cylinder; and means for controlling the pressure medium in said work cylinder during coupling engagement between said disks and when said disks are engaged whereby a coupling engagement pressure of the pressure medium in said work cylinder is less than a coupling engaged pressure of the pressure medium in said work cylinder.

5. The printing press coupling device in accordance with claim 4 wherein said control valve bleeds pressure medium from said work cylinder during said coupling engagement.

6. The printing press coupling device in accordance with claim 4 wherein said coupling engagement pressure is between one third and two thirds of said coupling engaged pressure.

7. The printing press coupling device in accordance with claim 4 further including a manometric switch usable to measure a pressure of the pressure medium in said work cylinder.

8. The printing press coupling device in accordance with claim 4 wherein said control valve includes a valve housing, a control piston slidable in said valve housing, a pressure spring engageable with said control piston, and a pressure sleeve situated in said valve housing, said control piston further including a control piston shaft and said pressure sleeve having a pressure sleeve bore, said control piston shaft passing through said pressure sleeve bore and being spaced therefrom by an annular bleed gap, said pressure sleeve being slidable in said housing and being in connection with said control piston through said pressure spring.

9. The printing press coupling device in accordance with claim 8 wherein said housing has a cone shaped flair, and further wherein said control piston has a cone-shaped head, said head being engageable with said flair.

10. The printing press coupling device of claim 4 wherein said coupling disks are engageable with each other in only one position.

11. The printing press coupling device of claim 4 wherein said cylinder coupling disk has a first set of spur teeth and wherein said driving wheel coupling disk has a second set of spur teeth, said first and second sets of spur teeth being engageable with each other.

12. The printing press coupling device of claim 4 wherein said control valve is carried by said driving wheel coupling disk and is engageable with said cylinder coupling disk.

* * * * *